US005842320A

United States Patent [19]

Chiu

[11] Patent Number: 5,842,320

[45] Date of Patent: Dec. 1, 1998

[54] PACKAGING MACHINE EQUIPPED WITH AN IMPROVED HOLE PUNCHING DEVICE AND ADJUSTABLE SEALING MECHANISM

[76] Inventor: Shao-Yi Chiu, No. 96, Kan-Jeh Lun, Da-Lin Chen, Chia-I Hsien, Taiwan

[21] Appl. No.: 988,637

[22] Filed: Dec. 11, 1997

[51] Int. Cl.[6] ..... P65B 61/02

[52] U.S. Cl. ..... 53/201; 53/141; 53/389.3

[58] Field of Search ..... 53/141, 167, 201, 53/389.3, 555, 562, 568

[56] References Cited

U.S. PATENT DOCUMENTS

| | | | |
|---|---|---|---|
| 3,043,071 | 7/1962 | Sadell | 53/141 X |
| 3,323,282 | 6/1967 | Duns | 53/201 X |
| 3,921,803 | 11/1975 | Reed et al. | 53/211 X |
| 4,185,443 | 1/1980 | Budzyn | 53/555 X |
| 4,635,316 | 1/1987 | Towns et al. | 83/308 X |
| 4,697,401 | 10/1987 | Kessler et al. | 53/201 X |
| 4,765,120 | 8/1988 | Phillips | 53/389.3 X |
| 4,924,659 | 5/1990 | Watanabe | 53/555 X |
| 5,027,579 | 7/1991 | Keip | 53/588 X |
| 5,381,640 | 1/1995 | Chiu | 53/77 |
| 5,423,161 | 6/1995 | Huson et al. | 53/588 X |
| 5,423,162 | 6/1995 | Chiu | 53/562 X |

*Primary Examiner*—Daniel B. Moon
*Attorney, Agent, or Firm*—Browdy and Neimark

[57] ABSTRACT

A packing machine is equipped with an improved hole punching device and an adjustable sealing mechanism. The hole punching device is equipped with a roller shaft having a number of spaced grooves for respectively housing a number of corresponding seats on which punching needles are secured so as to make a roll of film continually delivered for packing purpose to be punched with air passage holes; and an adjustable L-shaped locking device is fixed to the underside of a delivery set so as to make the delivery set easily adjusted and positioned in practical operation in proper alignment with the sealing mechanism. A piston connected sealing mechanism making the same opened and closed repeatedly can be adjusted of the opening extent by way of a wheel controlled screw rod with which the piston is engaged so as to permit articles of different sizes to be accommodated with readiness.

2 Claims, 6 Drawing Sheets

PACKAGING MACHINE EQUIPPED WITH AN IMPROVED HOLE PUNCHING DEVICE AND ADJUSTABLE SEALING MECHANISM

BACKGROUND OF THE INVENTION

The present invention relates to a packing machine equipped with improved hole punching device and adjustable sealing mechanism . The hole punching device is equipped with a roller shaft having a number of spaced grooves for respectively housing a number of corresponding seats on which punching needles are secured so as to make a roll of film continually delivered for packing purpose to be punched with air passage holes; and an adjustable L-shaped locking device is fixed to the underside of a delivery set so as to make the delivery set easily adjusted and positioned in practical operation in proper alignment with the sealing mechanism. A piston connected sealing mechanism making the same opened and closed repeatedly can be adjusted of the opening extent by way of a wheel controlled screw rod with which the piston is engaged so as to permit articles of different sizes to be accommodated with readiness.

Shrinkage films are prevalently adopted in the packing industry, so the packing machines associated with such a packing art have been designed and improved by many people skill in this art for many years. However, the currently used conventional packing machines are operated with the following disadvantages:

1. the hole punching device is made up of roller shafts and a number of sleeves each equipped with a plurality of punching needles, and the sleeves are removably mounted onto the roller shafts and fixed in place by screws. The sleeves must be adjusted individually to best fit the machine. Besides, the sleeves are easily out of engagement with the roller shafts as a result of loosening of the screws, causing the sleeves to operate in vain, or the damage of the shrinkage films.

2. the conventional delivery set is adjusted by way of a hand operated wheel which is associated with a screw rod and the adjustment of the wheel is time and effort consuming.

3. the opening and closing of the sealing mechanism is critical in its operation speed; conventional sealing mechanism is operated in a fixed mode and is not adjustable. So, time is wasted when small articles are packed because the mechanism is opened in excess for accommodation of the small articles in one aspect; and large articles can not be fitted in such a sealing mechanism at all in another aspect.

SUMMARY OF TIHE INVINTION

The primary object of the present invention is to provide a packing machine equipped with a hole punching device having a punching shaft to which a number of seats each provided with a plurality of punching pins or needles are firmly mounted.

Another object of the present invention is to provide a packing machine equipped with an adjustable delivery set which can be easily released and put in alignment with the sealing mechanism and locked in place by an L-shaped retaining means so as to make the delivery set easily adjusted in operation.

One further object of the present invention is to provide a packing machine equipped with a sealing mechanism which can be opened and closed repeatedly for sealing purpose and the extent of opening thereof can be properly adjusted according to the size of articles to be packed so as to make the sealing more efficient and speedy.

DETAILED DESCRIPTION OF THE PREFERRED EMBODIMENT

Figure 1:
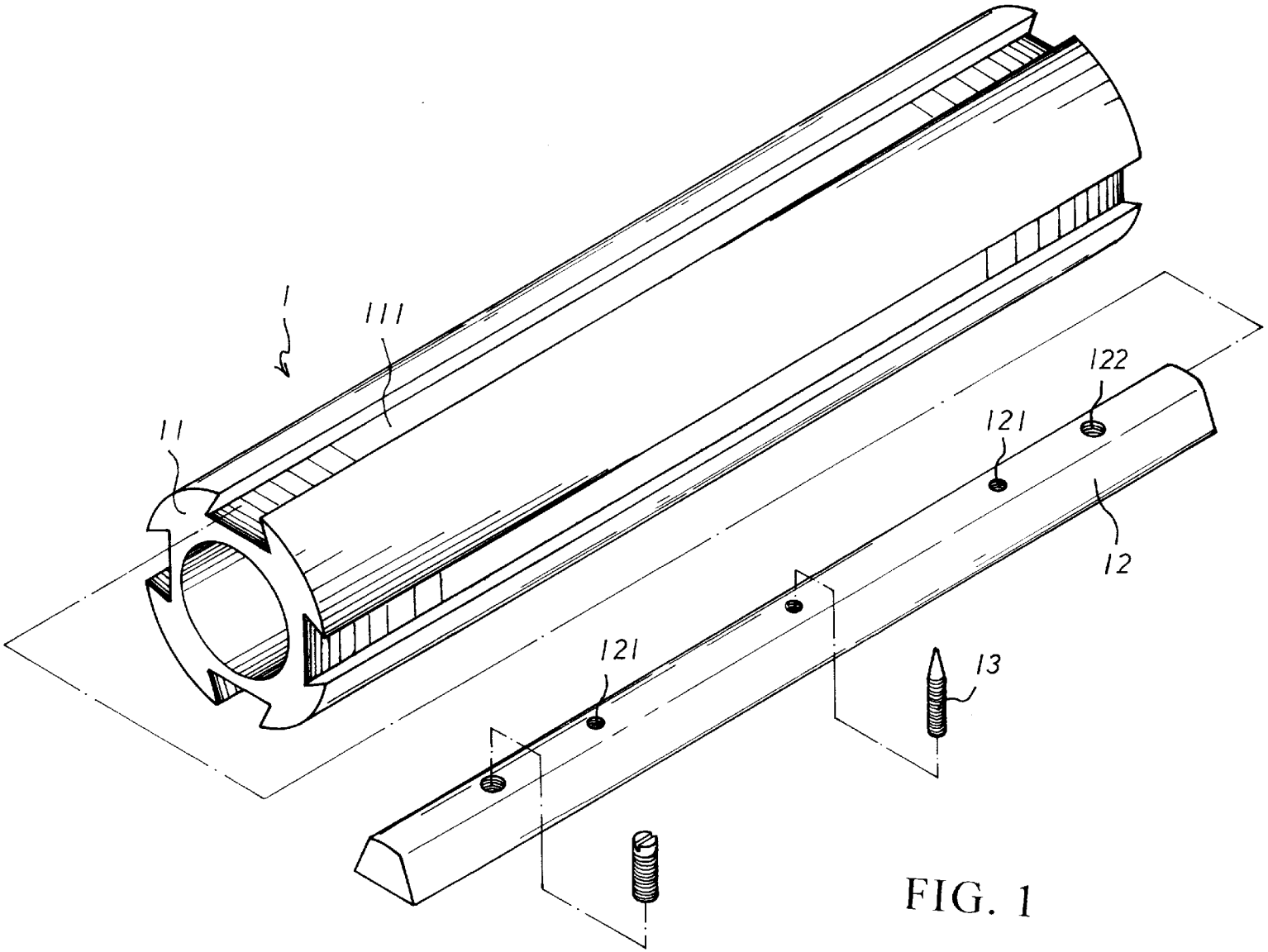
FIG. 1 is a diagram showing the structure of a tubular punching shaft and a corresponding seat thereof.
Figure 2:
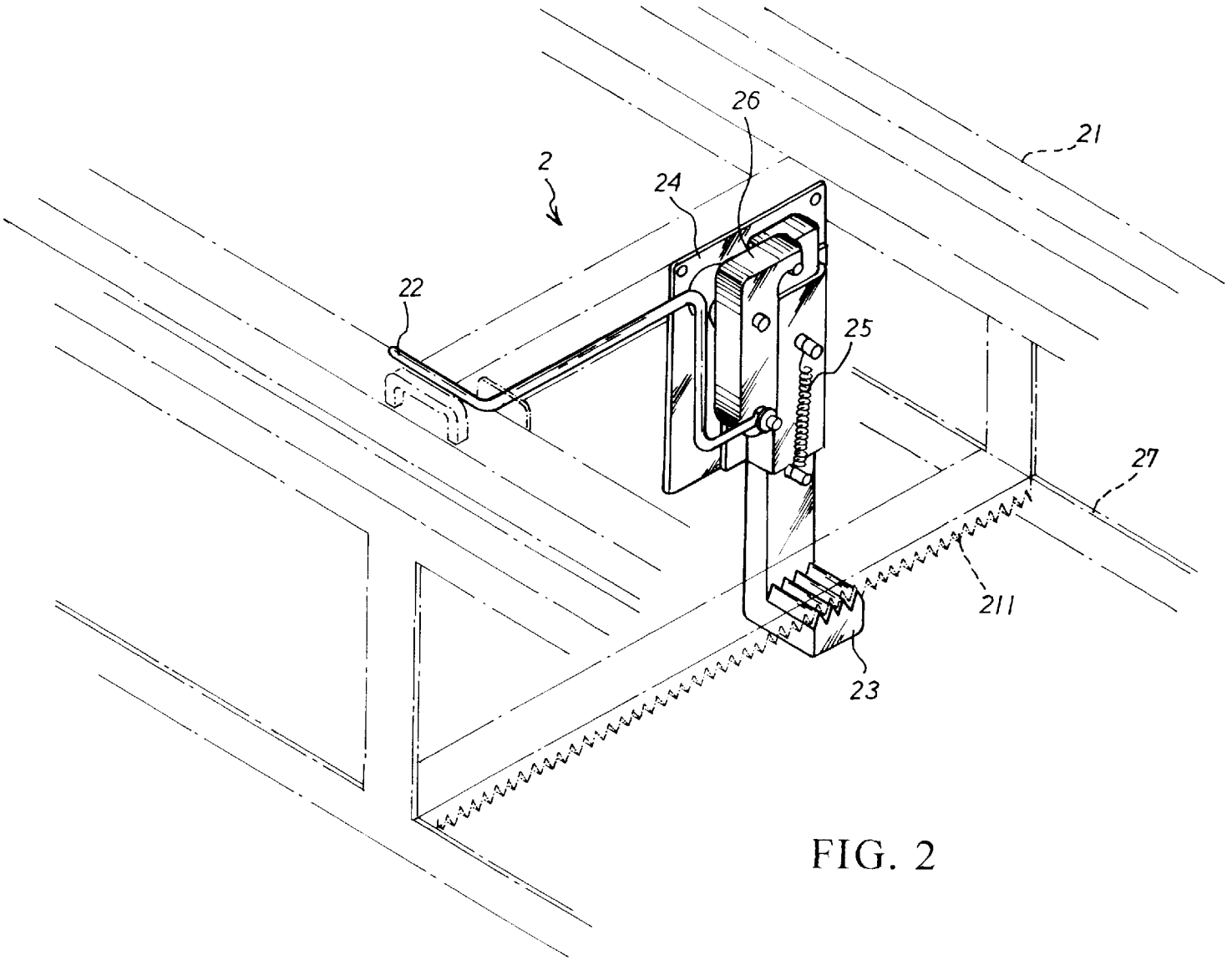
FIG. 2 is a diagram showing the delivery set of the present invention.
Figure 3:
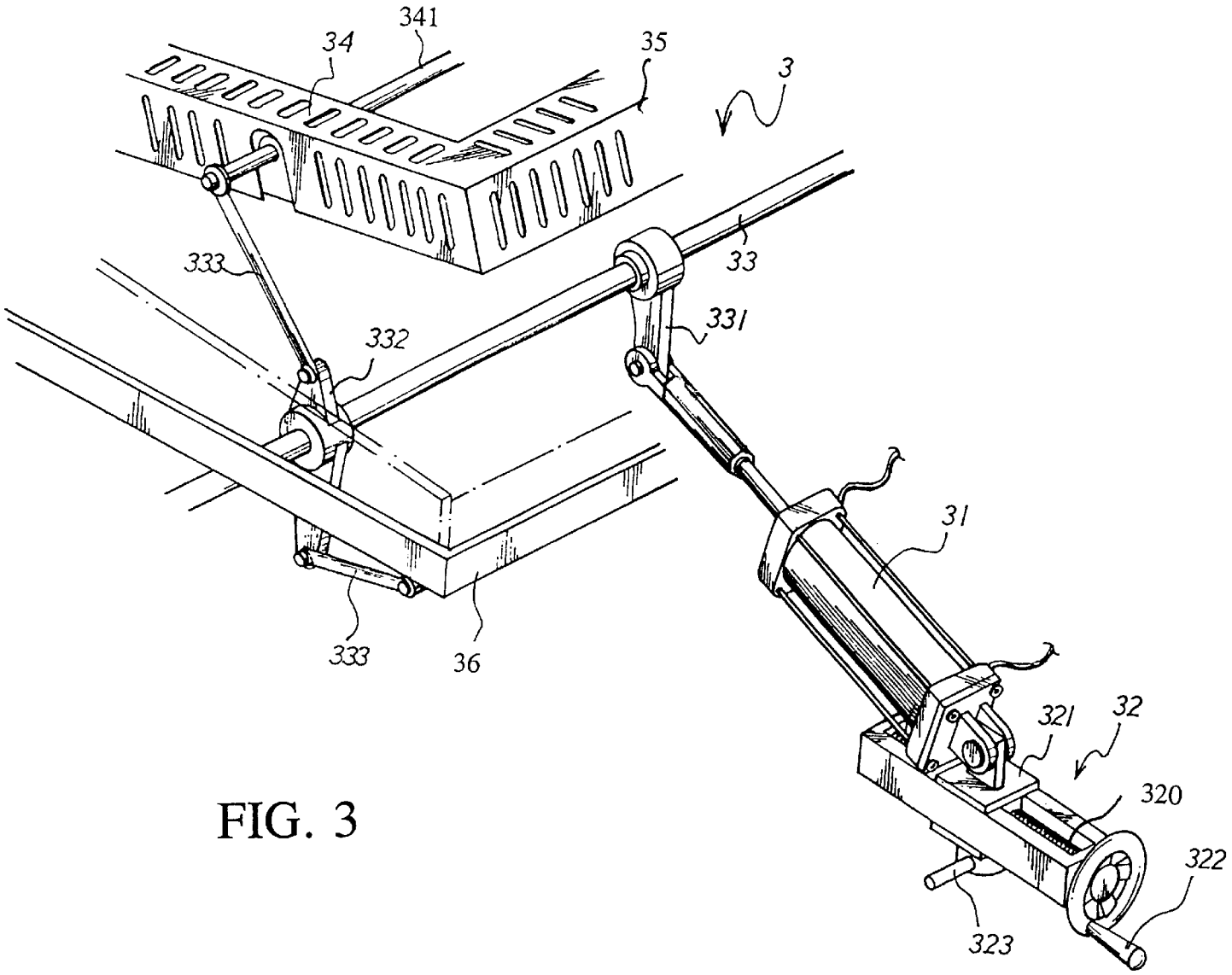
FIG. 3 is a diagram showing the detailed structure of the sealing assembly.

Referring to FIGS. 1, 2, 3, the present invention is mainly made up of a hole punching shaft 1,a delivery set 2, a sealing assembly 3. The punching shaft 1 is a tubular form having a number of equally spaced axial protrusions 11 and corresponding axially extended grooves 111 defined between every two of the protrusions 11. An elongated seat 12 made in a shape in conformance to each axially extended groove 111 so as to permit the seat 12 to become fitly engaged with each groove 111 when the punching shaft 1 is in rotation. The seat 12 is provided with a number of holes 121 for the mounting of pins13, and screw holes 122 for fixing the seat 12 in place, as shown in FIG. 1.

Referring to FIG. 2, the delivery set 2 is equipped with a delivery frame 21 having a bottom bracket 27. A laterally placed rack 211 which is engaged with an L-shaped geared block 23 is across disposed between two sides of the bracket 27. The L-shaped geared block 23 is slidably mounted onto a vertical board 24 which is fixed on a lateral beam extended between the delivery frame 21 and is retractably operated by way of a bias spring 25. The top end of the L-shaped geared block 23 is engaged with a driving block 26 which is pivotally fixed to the vertical board 24 and is further pivotally associated with and controlled by a crank arm 22. Pivotal operation of the crank arm 22 results in the pivotal movement of the driving block 26 which is then urged to push the L-shaped geared block 23 to move downwardly, as shown in FIG. 2.

Figure 4:
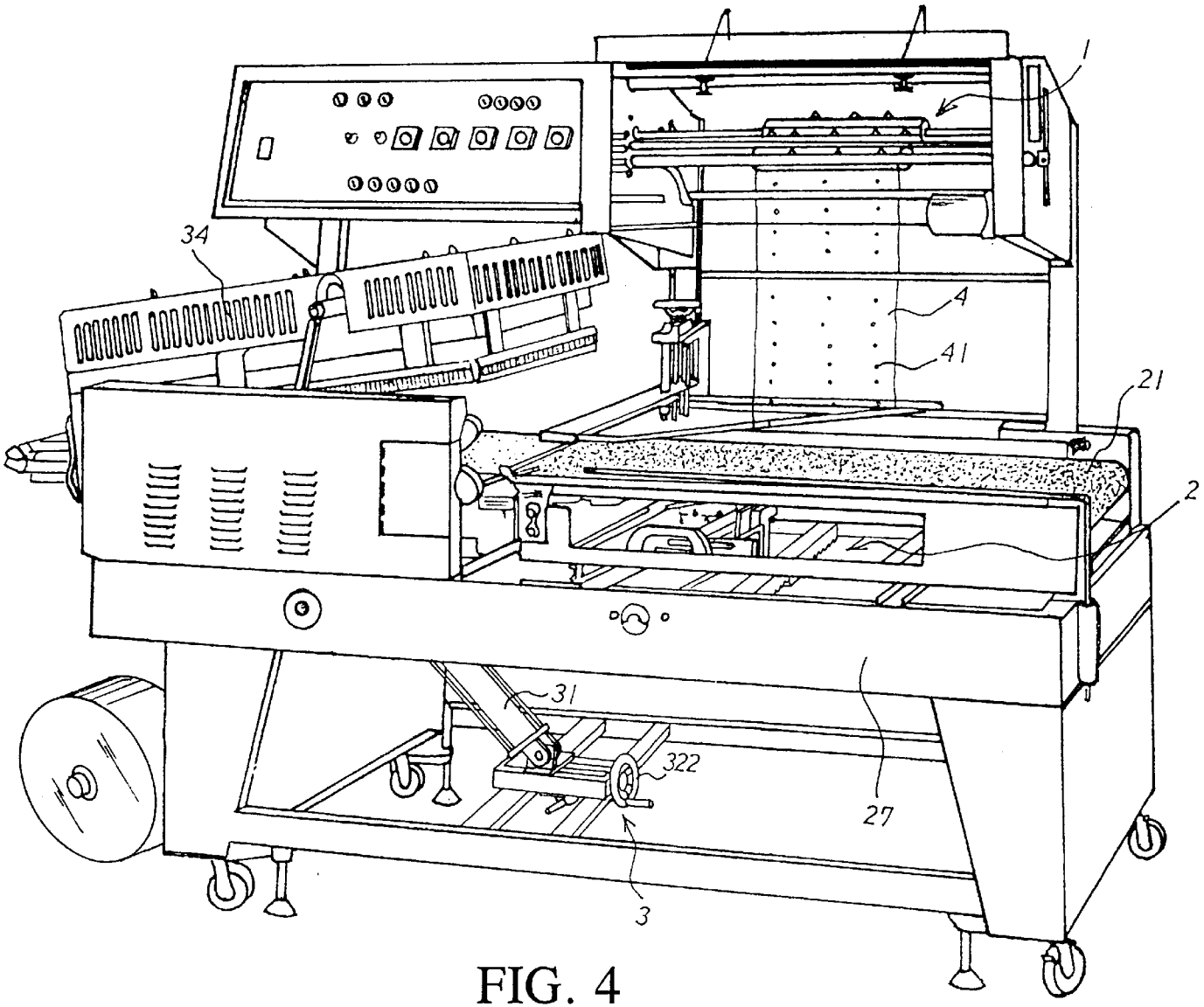
FIG. 4 is a diagram showing the installing of the present invention to a packing machine.

Referring to FIG. 3, the sealing assembly 3 is comprised of a cylinder 31, an adjusting set 32 , a rotary shaft 33 and a sealing device 34 having an upper jaw bracket 35 and a lower jaw bracket 36 that are hinged together. The movable end of the cylinder 31 is pivotally connected to one end of a linking bar 331 which is fixedly engaged with the rotary shaft 33 at the other end. The other end of the cylinder 31 is pivotally fixed to the a slidable adjustment plate 321 of the adjusting set 32 which is mounted to the bottom of the structural bracket 27, as shown in FIG. 4. At each end of the rotary shaft 33 is disposed a pivot lug member 332 which is connected to a supporting rod 341 of the sealing device 34 by a linkage 333, and the lower jaw bracket 36 in hinge connection to the upper jaw bracket 35 of the sealing device 34 at one end is coupled the pivot lug member 332 by a linkage 333, as shown in FIG. 5B.

Figure 5B:
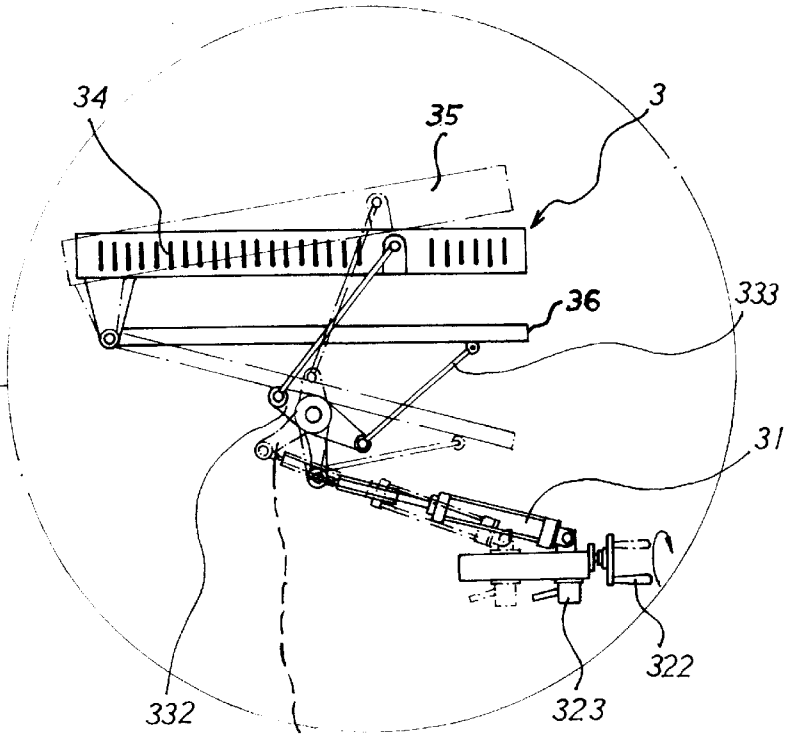
FIG. 5B is an enlarged diagram showing the operation of the sealing assembly.
Figure 5:
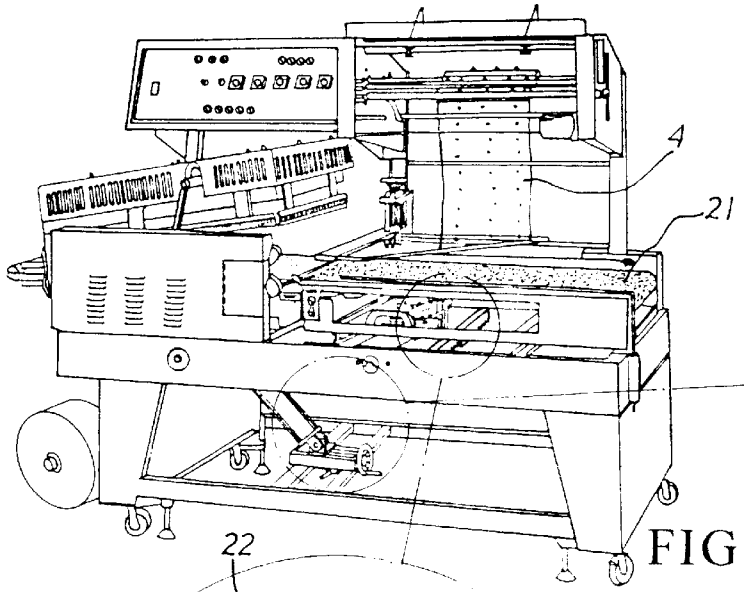
FIG. 5 is a diagram showing the locations and operations of the L-shaped geared block and the sealing assembly.
Figure 5A:
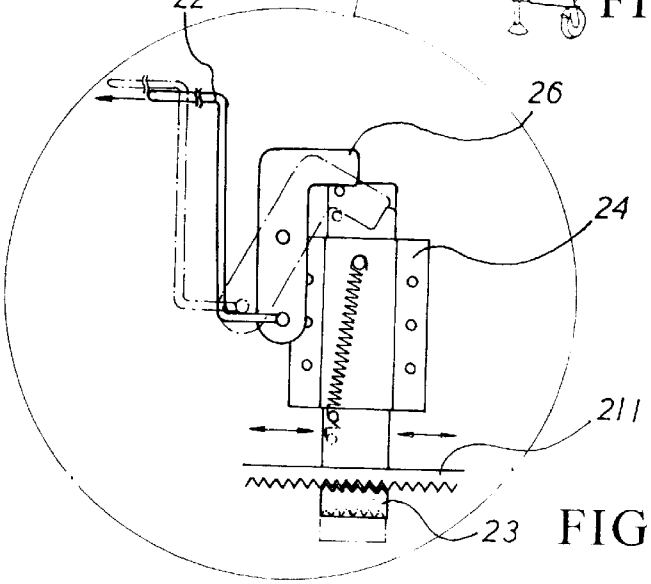
FIG. 5A is an enlarged diagram showing the operation of the L-shaped geared block.

The extending actuation of the cylinder 31 results in the spinning of the rotary shaft 33 and the pivotal movement of the two lug members 332 so as to cause the upper jaw bracket 35 and the lower jaw bracket 36 to move away from each other, i.e., to open for accommodation of articles, as shown in FIG. 5B. In contrast , the retraction of the cylinder 31 results in the reverse spinning of the punching shaft 33 so as to cause the upper jaw bracket 35 and the lower jaw bracket 36 to come close to each other, i.e., to close in a sealing stroke.

To adjust the opening extent of the sealing mechanism, the control wheel 322 can be rotatably adjusted to make the adjustment plate 321 to which the bottom end of the cylinder 31 is pivotally mounted slidably adjusted with respect to a screw rod 320 and the adjustment plate 321 is further locked in place by a fixing device 323.

As shown in FIG. 4, the hole punching device 1 made up of the punching shaft 11 having a number of grooves 111 for receiving the seats 12 respectively is used to plant a plurality of air holes 41 continually on a roll of shrinkage film 4 for air to penetrate therethrough. The seats 12 are firmly engaged with the punching shaft 11 by way of the grooves 111 so as to make the assembly and adjustment of the punching shaft easy and quick.

Besides, the delivery set 21 is fixed in place by way of the L-shaped retaining means having a spring biased L-shaped geared block 23 vertically adjustable by way of the driving block 26 in connection to the crank arm 22 at one end and engaged with the vertically movable geared block 23 at the other end. Thus, the L-shaped retaining means can be controlled to engage with due to the bias spring 25 which can pull the L-shaped geared block 23 upward and pivot the driving block 26 resume its non-operative position or disengage from the rack 211 by actuation of the crank arm 22 so as to make the delivery frame 21 adjustable and relocked in place accordingly.

When an article is delivered to the sealing mechanism 34 by way of the delivery set 21, the continual extending and retracting strokes of the cylinder 31 results in the clockwise and counterclockwise rotation of the rotary shaft 33, causing the upper jaw bracket 35 and the lower jaw bracket 36 of the sealing mechanism 34 to open and close respectively by way of the linkages 333 engaged with the ends of the lugs 332 secured to the rotary shaft 33. The bottom of the cylinder 31 is pivotally mounted onto the adjustment plate 321 which is linearly movable and engaged with the screw rod 320 controlled by a handle operated wheel 322 so that the relative position of the cylinder 31 can be changed as a result of the movement of the adjustment plate 321. So, the extent of the opening and closing of the sealing mechanism 34 is controllably varied by actuation of the wheel 322 in either way so as to make the sealing mechanism 34 suit for articles of different sizes. That will make the sealing operation more speedy and efficient.

Figures 6, 6A:
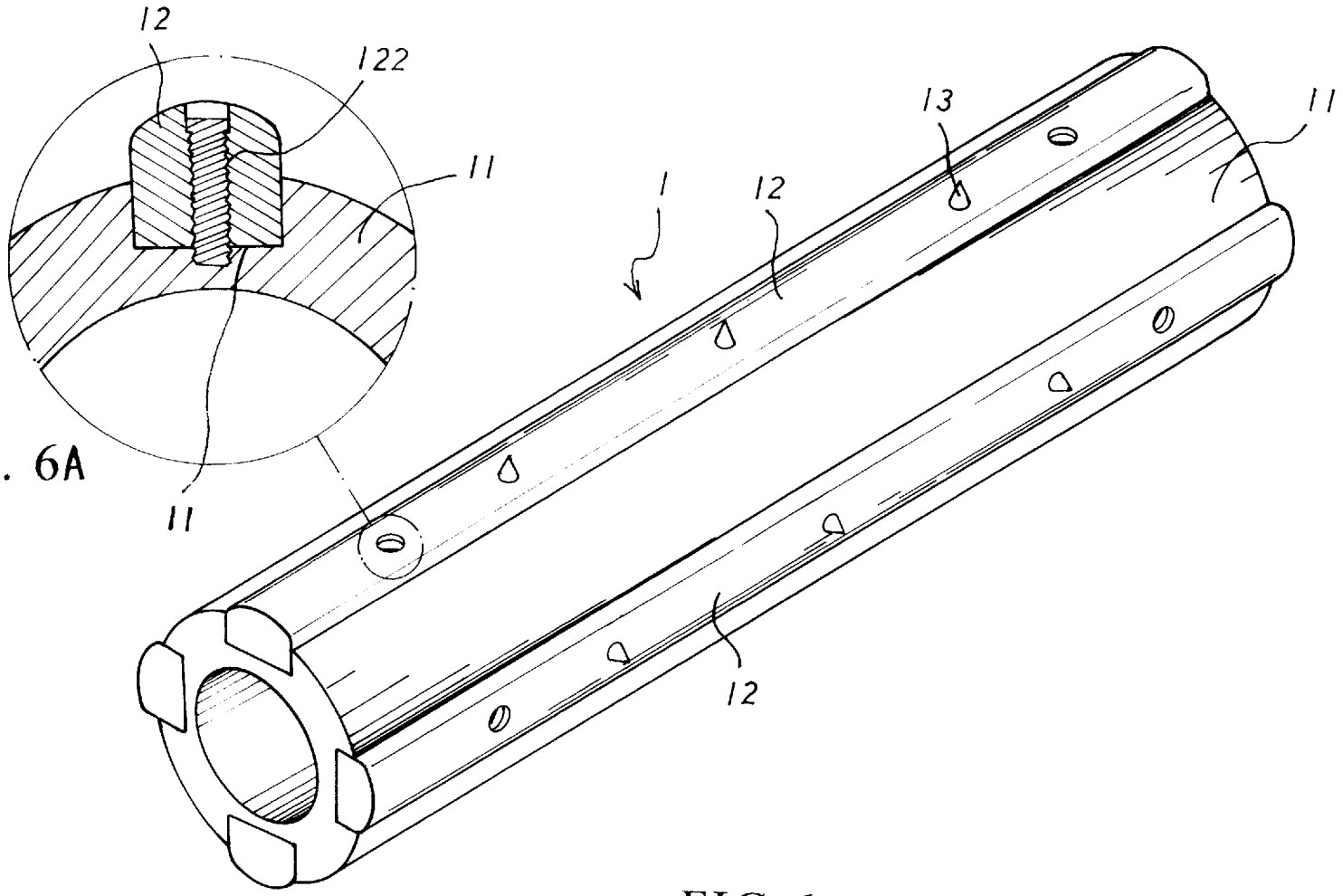
FIG. 6 is a diagram showing another embodiment of the punching shaft of the present invention.
FIG. 6A is an enlarged sectional view of the mounting of a seat to the punching shaft.

Moreover, as shown in FIG. 6, in the second embodiment, the punching shaft 1 can be designed to have a number of grooves 11 which have a substantially square or rectangular cross section so as to accommodate correspondingly cut elongated seats 12 accordingly with readiness and the seats 12 are firmly secured in the grooves by screws 122 respectively.

I claim:

1. An improved packing machine comprising a hole punching device, a delivery set, a sealing assembly; wherein the improvements are characterized by that:

said punching device having a shaft being a tubular form having a number of equally spaced axial protrusions and corresponding axially extended grooves defined between every two of said protrusions;

a plurality of elongated seats being made in conformance in shape to each axially extended groove so as to permit each seat to become fitly engaged with each groove when said punching shaft being in rotation;

each said seat being provided with a number of holes for the mounting of pointed pins, and screw holes for fixing said seat in place;

said delivery set being equipped with a delivery frame having a bottom bracket; a laterally placed rack which is engaged with an L-shaped geared block which being disposed across between two sides of said bracket;

said L-shaped geared block being slidably mounted onto a vertical board which being fixed on a lateral beam extended between said delivery frame and being retractably operated by way of a bias spring;

the top end of said L-shaped geared block being engaged with a driving block which being pivotally fixed to said vertical board and being further pivotally associated with and controlled by a crank arm; pivotal operation of said crank arm resulting in the pivotal movement of the driving block which being then urged to push said L-shaped geared block to move downwardly;

said adjustable sealing assembly further comprising:

a cylinder, an adjusting set , a rotary shaft and a sealing device having an upper jaw bracket and a lower jaw bracket that being hinged together;

a movable end of said cylinder being pivotally connected to one end of a linking bar which being fixedly engaged with said rotary shaft at the other end;

another end of said cylinder being pivotally fixed to a slidable adjustment plate of said adjusting set which being mounted to the bottom of the structural bracket;

at each end of said rotary shaft being disposed a pivot lug member which being connected to a supporting rod of said sealing device by a linkage, and said lower jaw bracket in hinge connection to said upper jaw bracket of said sealing device at one end being coupled to the pivot lug member by a linkage;

whereby the extending actuation of said cylinder results in the spinning of the punching shaft and the pivotal movement of said two lug members so as to cause said upper jaw bracket and said lower jaw bracket to move away from each other, i.e., to open; a control wheel can be rotatably adjusted to make said adjustment plate to which the bottom end of said cylinder is pivotally mounted slidably adjusted and the adjustment plate is further locked in place by a fixing device.

2. An improved packing machine as claimed in claim 1 wherein said hole punching device is made up of said tubular shaft having a number of grooves for receiving said corresponding seats; each said groove as well as each corresponding seat has a cross section of a rectangular or square shape so as to permit each said seat to be easily engaged with each said groove and fixed in place by screws.

* * * * *